US005675987A

United States Patent [19]

Nakajima

[11] Patent Number: 5,675,987

[45] Date of Patent: Oct. 14, 1997

[54] ORNAMENTAL PIERCED EAR RINGS

[76] Inventor: Takeshi Nakajima, 46-8, Takinogawa 5-chome, Kita-ku, Tokyo, Japan

[21] Appl. No.: 773,549

[22] Filed: Dec. 27, 1996

Related U.S. Application Data

[63] Continuation of Ser. No. 494,517, Jun. 26, 1995, abandoned.

[30] Foreign Application Priority Data

Jun. 30, 1994 [JP] Japan ..... 6-171875

[51] Int. Cl.[6] ..... A44C 7/00

[52] U.S. Cl. ..... 63/12

[58] Field of Search ..... 63/12; 24/3.6, 24/3.11, 716

[56] References Cited

U.S. PATENT DOCUMENTS

| | | | |
|---|---|---|---|
| 4,425,687 | 1/1984 | Sauer | 63/12 X |
| 4,686,837 | 8/1987 | Carre | 63/12 X |

FOREIGN PATENT DOCUMENTS

| | | | |
|---|---|---|---|
| 638558 | 5/1928 | France | 63/12 |
| 2474839 | 8/1981 | France | 63/12 |
| 335499 | 2/1936 | Italy | 63/12 |

*Primary Examiner*—Joanne Silbermann

*Attorney, Agent, or Firm*—Armstrong, Westerman Hattori, McLeland & Naughton

[57] ABSTRACT

Pierced ear-rings comprising a pin member having a securing portion at a head of a pin shaft pierced through an earlobe for securing an ornamental member and an engaging recess formed at the top end around an axis, and a stopping member engaged detachably to the engaging recess of the pin member, wherein the stopping member comprises a through hole through which the pin shaft is passed, a stopping member main body having a hollow portion formed from a circumferential surface of the stopping member to traverse the through hole and an engaging spring having a bent portion at a base end and two spring legs extended from the bent portion and fitted in the follow portion of the stopping member main body such that the two spring legs oppose to both sides of the through hole.

26 Claims, 4 Drawing Sheets

ORNAMENTAL PIERCED EAR RINGS

This application is a continuation of application Ser. No. 08/494,517 filed Jun. 26, 1995, now abandoned.

BACKGROUND OF THE INVENTION

1. Field of the Invention

The present invention concerns ornamental pierced ear-rings which are pierced through user's ear-lobes in use.

2. Description of the Prior Art

In ornamental pierced ear-rings, a stopping member or a post catcher is detachably secured to the top end of a pin pierced through an earlobe so as not to slip off.

In the prior art, as shown in FIG. 9, a pair of bent leaf springs 31, 31 are disposed being opposed to each other, behind a stopping member 30 and an engaging portion at the top end of a pin member 33 passing through a through hole 32 of the stopping member 30 is put between the paired springs 31, 31.

However, in the structure described above, the springs would be worn and open outwardly during use to lose spring resiliency and often slip off. Further, since the stopping member is exposed to the outside, it is often caught by hairs or the like and has no good appearance as well.

Further, while the thickness of earlobes is different depending on individual user, the pierced ear-rings of the prior art have an engaging portion only at one position, so that it sometimes occurs that they are attached to the earlobes too tightly or too loosely depending on the user.

Further, in the pierced ear-rings of the prior art, since the pin is made of a metal material, metal allergy such as inflammation or rash may be caused depending on the user and this problem can not be solved completely even if an inert material such as gold is used for the pin.

OBJECT OF THE INVENTION

A first object of the present invention is to provide pierced ear-rings capable of easily attaching and detaching a stopping member and enduring long time use.

A second object of the present invention is to provide pierced ear-rings capable of changing an engaging position for the stopping member in accordance with the thickness of an earlobe.

A third object of the present invention is to provide pierced ear-rings not causing allergic symptoms such as rash or inflammation.

SUMMARY OF THE INVENTION

The first object can be attained in accordance with the present invention by pierced ear-rings comprising;

a pin member having a securing portion at a head of a pin shaft pierced through an earlobe for securing an ornamental member and an engaging recess formed at the top end around an axis, and a stopping member engaged detachably to the engaging recess of the pin member wherein the stopping member comprises;

a through hole through which the pin shaft is passed, a stopping member main body having a hollow portion formed from a circumferential surface of the stopping member to traverse the through hole and an engaging spring having a bent portion at a base end and two spring legs extended from the bent portion and fitted in the follow portion of the stopping member main body such that the two spring legs oppose to both sides of the through hole.

The second object can be attained in accordance with the present invention by the pierced ear-rings described above in which the engaging recess in the form of a plurality of grooves spaced apart axially from each other around an axis at a top end of the pin shaft.

The third object can be attained in accordance with the present invention by the pierced ear-rings described above in which the pin has a flanged receiving member formed integrally to the top end for securing an ornamental member, and the pin member including the flanged receiving member and the stopping member are made of a synthetic resin material.

When the top end of the pin member is passed through a central through hole of the stopping member, the pin shaft is inserted while forcibly opening outwardly the spring members situating on both sides of the through hole inside of the stopping member and, when the pin shaft is forced as far as the engaging recess of the stopping member, the spring member snugly engages the engaging recess of the pin member to retain the pin at the inside of the stopping member.

In a preferred embodiment having an engaging recess in the form of a plurality of grooves, the engaging position between the pin and the stopping member can be changed in accordance with the thickness of the ear-lobe.

Since portions in contact with an ear, that is, the pin member including the flanged receiving member and the stopping member are made of a synthetic resin, metal portions are kept from contact with the inside and both sides of the ear-lobe.

BRIEF DESCRIPTION OF THE ACCOMPANYING DRAWINGS

DESCRIPTION OF THE PREFERRED EMBODIMENTS

The present invention will be explained by way of preferred embodiments with reference to the drawings.

Figure 1:
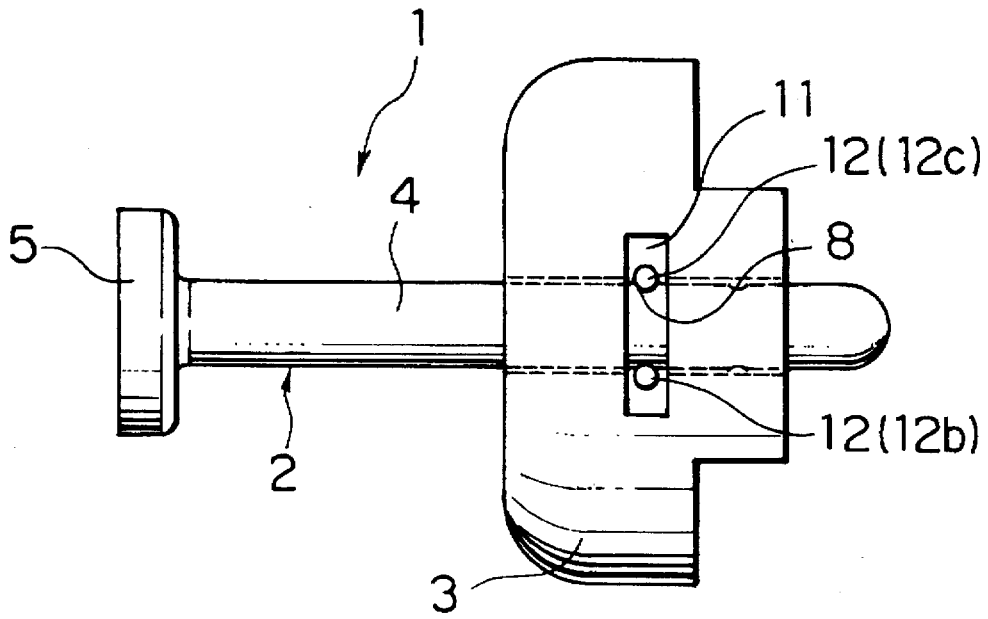
FIG. 1 is a view illustrating an entire structure of pierced ear-rings as a preferred embodiment according to the present invention.

As shown in FIG. 1, one of pierced ear-rings 1 comprises a pin member 2, and a stopping member 3 engaged to a top end of the pin member 2.

Figure 2:
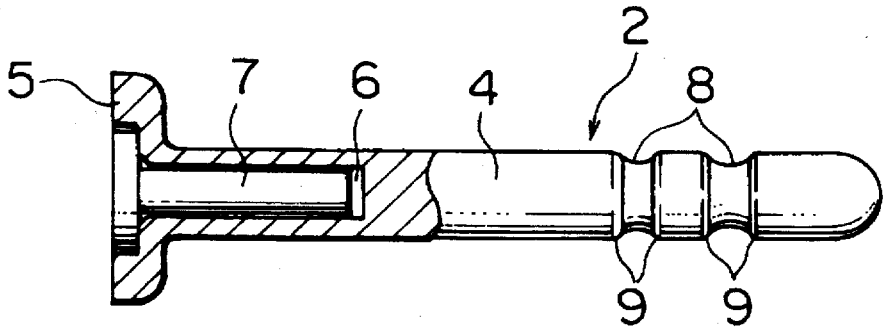
FIG. 2 is an explanatory view partially in cross section of a pin member.

As shown in FIG. 2, the pin member 2 has a flanged receiving member 5 formed integrally at one end of a pin shaft 4 for securing an ornamental article such as a jewel. In the embodiment shown in FIG. 2, a threaded hole 6 is formed along an axial center of the pin shaft 4 from the receiving member 5 of the pin member 2, and a small screw 7 is screwed into the threaded hole 6 for setting a jewel or the like.

The pin member 2 has an engaging recess 8 formed around the axis of the pin shaft 4 at the top end. Preferably, engaging recesses 8, 8 are formed as a plurality of grooves spaced apart axially from each other around the axis at the top end of the pin shaft 4 as shown in FIG. 2. By providing the engaging recesses 8, 8 in the form of a plurality of grooves, the position for the stopping member 3 can be changed in accordance with the thickness of an earlobe by adjusting the distance from the back of the flanged receiving member 5 of the pin member 2 to the stopping member 3.

Each of the engaging recesses 8, 8 is preferably formed as an annular recessed groove of an arcuate cross section as shown in FIG. 2, and an edge 9 for the recessed groove is desirably rounded for facilitating insertion and withdrawal of the stopping member 3.

Figure 3:
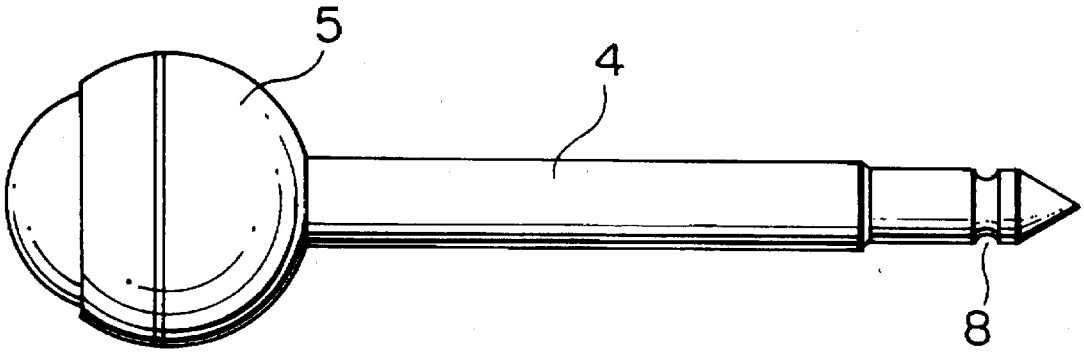
FIG. 3 is a side elevational view of a pin member in another embodiment.

The pin member 2 of the embodiment shown in FIGS. 1 and 2 is a pierce constituent member mounted to a hole perforated through the earlobe and, for this purpose, the top end of the pin shaft of 1 mm diameter is rounded. A pin member 2 of another embodiment shown in FIG. 3 is a pierce constituent member for forming a through hole to the earlobe, in which the basic constitution is identical with that of the embodiment shown in FIG. 1 excepting for sharpening the top end and making the diameter of a portion to pierce the earlobe somewhat greater than that of the mounting portion for the stopping member.

Figure 4:
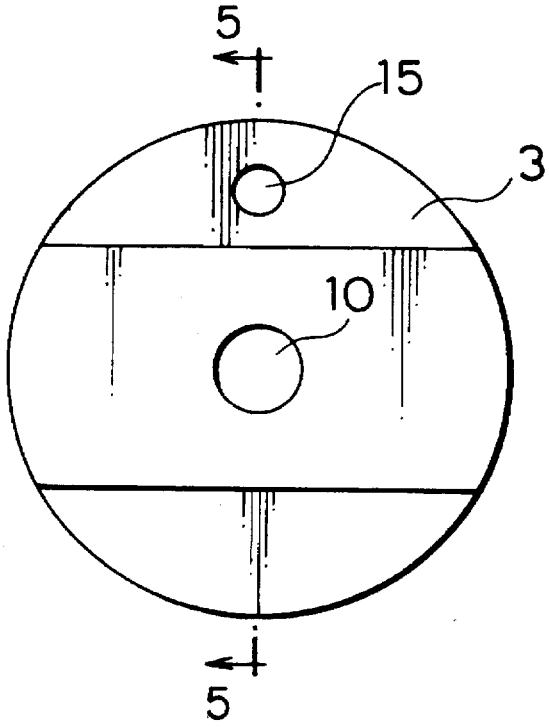
FIG. 4 is an rear elevational view of a stopping member.
Figure 5:
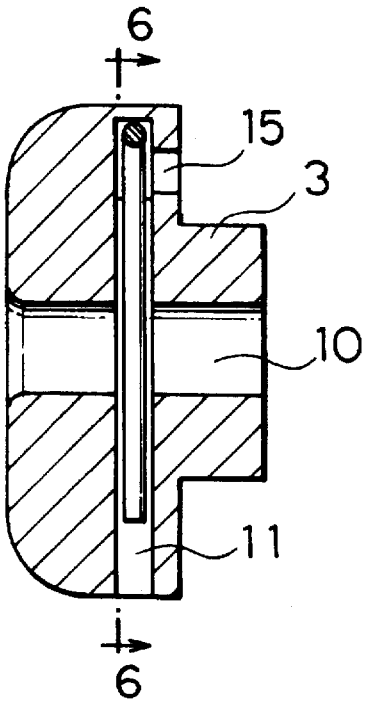
FIG. 5 is a cross sectional view taken along a line A—A of the stopping member shown in FIG. 4.
Figure 6:
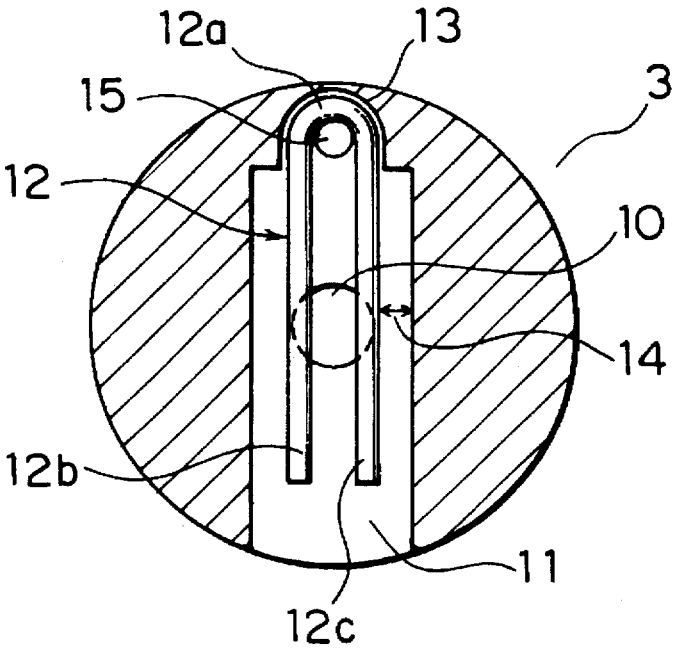
FIG. 6 is a cross sectional view taken along a line B—B of the stopping member shown in FIG. 5.

As shown in FIG. 4, the stopping member 3 has a through hole 10 formed at a central portion for inserting the shaft 4 of the pin member 2 and, also as shown in FIGS. 5 and 6, has a hollow portion 11 formed so as to traverse the through hole 10 from the circumferential surface of the stopping member 3.

The lateral size between right and left walls of the hollow portion 11 as viewed in FIG. 5 is somewhat greater than the diameter of the through hole 10 and the lateral size between right and left walls of the hollow portion as viewed in FIG. 5 is somewhat greater than the diameter of a wire material of an engaging spring 12. The hollow portion 11 has a fitting portion 13 formed at the rear end for receiving a base end bent portion 12*a* of the engaging spring 12 to be described later.

The engaging spring 12 is mounted in the hollow portion 11 of the stopping member 3. The engaging spring 12 has a V-shaped or U-shaped bent portion 12*a* formed at a base end and two spring legs 12*b*, 12*c* extending from the bent portion 12*a*, and they are structured such that the spring legs 12*b*, 12*c* on both sides are provided with resiliency by the spring force of the bent portion 12*a*.

Then, as shown in FIGS. 1, 5 and 6, the engaging spring 12 is fitted in the hollow portion 11 of the stopping member 3 such that the base end bent portion 12*a* is fitted in the fitting portion 13 at the rear end of the hollow portion 11, spring legs 12*b*, 12*c* on both sides oppose to the through hole 10 on both sides thereof, and a gap 14 is defined between each of the spring legs 12*b*, 12*c* and the inside of the hollow portion 11.

Figure 7:
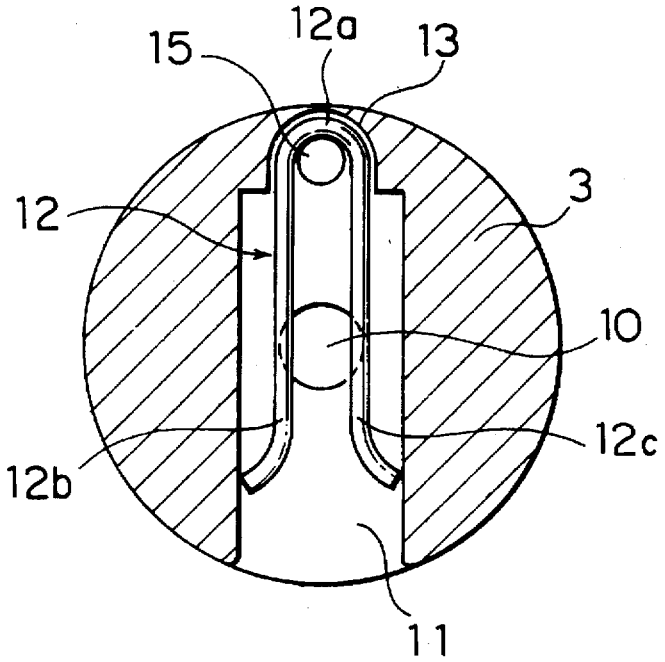
FIG. 7 is a view, corresponding to FIG. 6, for a further embodiment according to the present invention.

The paired spring legs 12*b*, 12*c* of the engaging spring 12 may be made free at the top ends as shown in FIG. 6, or the spring legs 12*b*, 12*c* may be diverged at the top ends toward walls of the hollow portion 11 as shown in FIG. 7 such that the diverged top ends abut against the wall of the hollow portion 11 when the spring legs 12*b*, 12*c* are forced to open outwardly by the pin shaft 4, to provide a strong spring force to the spring legs.

It is necessary that the engaging spring 12 is mounted so as not to easily slip out of the hollow portion 11 of the stopping member 3. As a means for this purpose in this illustrated embodiment, a hole 15 is perforated from one surface of the stopping member 3 to the inside of the fitting portion 13 of the hollow portion 11 for receiving the engaging spring, and a heated metal bar is inserted into the hole 15 to melt a resin material at the periphery of the aperture 15 and bonded to the vicinity of the bent portion 13 of the engaging spring 12.

In such a structure, when the molten resin is adhered to the bent portion 12*a* of the engaging spring 12, the engaging spring 12 is kept from dropping out of the hollow portion 11.

However, the anti-slip off means for the engaging spring 12 is not restricted only to the above described means. For instance, other appropriate means than the metal bar may be fitted into the hole 15 or adhesives may be filled into the hole for securing the bent portion 12*a* of the engaging spring 12. Further, if the bent portion 12*a* of the engaging spring 12 is tightly fitted to the fitting portion 13 of the hollow portion 11, the hole 15 itself may be saved.

Figure 8:
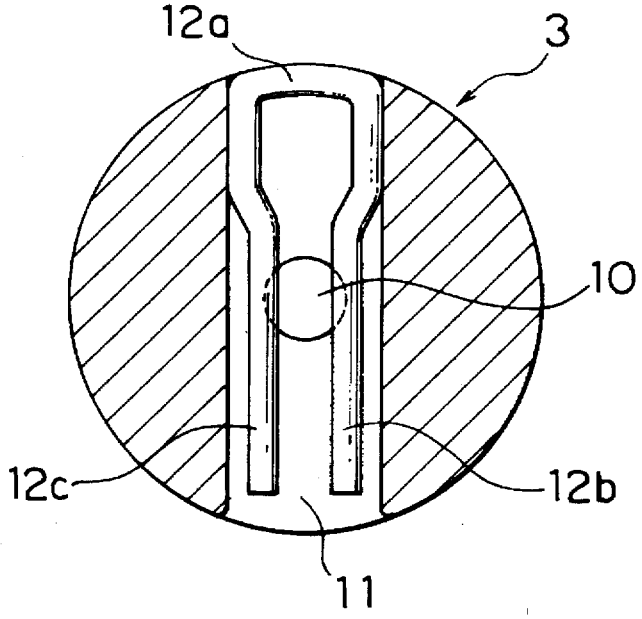
FIG. 8 is a view, corresponding to FIG. 6, for a still further embodiment according to the present invention.
Figure 9:
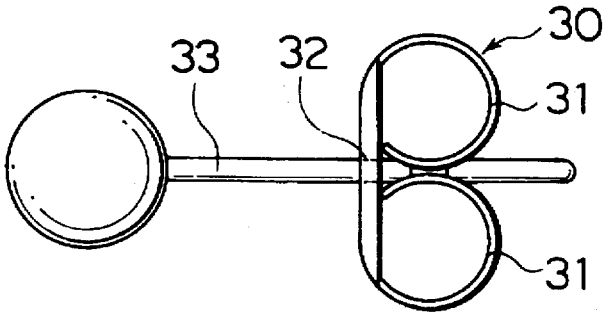
FIG. 9 PRIOR ART
FIG. 9 is an explanatory view for a main portion of pierced of the prior art.

FIG. 8 shows a still further embodiment of the present invention. In this embodiment, a bent portion 12*a* of the engaging spring 12 is formed to such a size as forcibly fitted into the hollow portion 11 of the stopping member 3, and the spring legs 12*b*, 12*c* are restricted inwardly and opposed to the through hole 10 of the stopping member 3.

For avoiding troubles caused by metal allergy, the pierced earings 1 according to the present invention preferably has the flanged receiving portion 5 formed integrally at one end of the pin member, and the receiving portion, the pin shaft 4 and the stopping member 3 are molded with a synthetic resin such as polycarbonate, so that no metal portions are in contact at all with the inside and both sides of the earlobe. The resin used herein is preferably polycarbonate but any of other resins may be used so long as they have similar hardness and easy fabricability.

In the pierced ear-rings according to the present invention, since the stopping member incorporating the engaging spring is fitted to the top end of the pin shaft, and the engaging recess of the pin shaft and the spring of the stopping member are engaged snugly at the inside of the stopping member, the stopping member can be attached to and detached from the pin shaft easily, with no worry of slipping out of the engagement.

Further, since the engaging spring is not exposed to the outside, there is no worry that the spring is caused to open outwardly by being caught, for example, on hairs or the spring forcibly pull the hairs.

Further, since a plurality of engaging recess are disposed axially spaced apart from each other to the pin shaft, the stopping member can be retained at an appropriate position in accordance with the thickness of the earlobe.

Further, since all the portions in contact with an ear are formed with a synthetic resin, there is no worry of causing inflammation or rash due to allergy thereby providing hygienic safety to a user's body.

What is claimed is:

1. Pierced ear-rings, comprising:

a pin member including a pin shaft and at least one engaged recess located circumferentially around said pin shaft, said pin shaft having a central longitudinal axis and first and second opposing ends and said at least one engaging located near said first end of said pin shaft, wherein said pin shaft is capable of being pierced through an earlobe of a wearer of said pierced ear-rings for securing an ornamental member on said wearer's earlobe; and a stopping member detachably engagable to said engaging recess of said pin member, wherein said stopping member comprises:

a through hole through a center of a main body of said stopping member which said pin shaft is passed;

a hollow portion in said main body of said stopping member, wherein said hollow portion is formed from an opening in a circumferential surface of said stopping member perpendicularly inwardly of said circumferential surface so that said hollow portion traverses said through hole;

an engaging spring having a bent portion at a base end thereof and two spring legs extending from said bent portion, said engaging spring being force fitted into said hollow portion of said main body of said stopping member such that said two spring legs are located on two opposite sides of said through hole, said bent portion fitting into a fitting portion of said hollow portion of said main body of said stopping member and being force fitted into said hollow portion of said stopping member main body;

wherein said hollow portion of said stopping member main body extends in a lateral direction generally perpendicular to a central axis of said through hole and through an opening in said circumferential surface of said stopping member such that said engaging spring is force fitted by being pushed into said opening; and wherein said hollow portion has a generally constant width, in a direction perpendicular to both said central axis and said lateral direction, said bent portion extending across said width and a distance along said opposite sides of said hollow portion, said spring legs angling inward a distance from said bent portion and then extending generally straight spaced from said opposite sides of said hollow portion and extending over side portions of said through hole.

2. The pierced ear-rings as defined in claim 1, wherein said engaging recess includes a plurality of grooves spaced apart axially from each other formed around said central longitudinal axis and located at said first end of said pin shaft.

3. The pierced ear-rings as defined in any one of claims 1 and 2, wherein said pin member has a flanged receiving member formed integrally to said second end thereof for securing said ornamental member, and said pin member including said flanged receiving member and said stopping member are made of a synthetic resin material.

4. The pierced ear-rings as defined in claim 1, wherein said spring legs are angled inwardly from said bent portion towards said through hole and away from said opposite sides of said hollow portion of said stopping member main body.

5. Pierced ear-rings, comprising:

a pin member including a pin shaft and at least one engaged recess located circumferentially around said pin shaft, said pin shaft having a central longitudinal axis and first and second opposing ends and said at least one engaging located near said first end of said pin shaft, wherein said pin shaft is capable of being pierced through an earlobe of a wearer of said pierced ear-rings for securing an ornamental member on said wearer's earlobe; and a stopping member detachably engagable to said engaging recess of said pin member, wherein said stopping member comprises:

a through hole through a center of a main body of said stopping member which said pin shaft is passed;

a hollow portion in said main body of said stopping member, wherein said hollow portion is formed from an opening in a circumferential surface of said stopping member perpendicularly inwardly of said circumferential surface so that said hollow portion traverses said through hole;

an engaging spring having a bent portion at a base end thereof and two spring legs extending from said bent portion, said engaging spring being force fitted into said hollow portion of said main body of said stopping member such that said two spring legs are located on two opposite sides of said through hole, said bent portion fitting into a fitting portion of said hollow portion of said main body of said stopping member and being force fitted into said hollow portion of said stopping member main body; and wherein said hollow portion of said stopping member main body extends in a lateral direction generally perpendicular to a central axis of said through hole and through an opening in said circumferential surface of said stopping member such that said engaging spring is force fitted by being pushed into said opening.

6. The pierced ear-rings as defined in claim 5, wherein said engaging recess includes a plurality of grooves spaced apart axially from each other formed around said central longitudinal axis and located at said first end of said pin shaft.

7. The pierced ear-rings as defined in claim, 6, wherein said pin member has a flanged receiving member formed integrally to said second end thereof for securing said ornamental member, and said pin member including said ranged receiving member and said stopping member are made of a synthetic resin material.

8. The pierced ear-rings as defined in claim 5, wherein said pin member has a flanged receiving member formed integrally to said second end thereof for securing said ornamental member, and said pin member including said ranged receiving member and said stopping member are made of a synthetic resin material.

9. The pierced ear-rings as defined in claim 5, wherein said spring legs are angled inwardly from said bent portion towards said through hole and away from said opposite sides of said hollow portion of said stopping member main body.

10. The pierced ear-rings as defined in claim 5, wherein said hollow portion has a generally constant width, in a direction perpendicular to both said central axis and said lateral direction, said bent portion extending across said width and a distance along said opposite sides of said hollow portion, said spring legs angling inward a distance from said bent portion and then extending generally straight spaced from said opposite sides of said hollow portion and extending over side portions of said through hole.

11. A pierced ear-ring comprising:

a pin means for slidingly inserting through a hole in a wearer's ear, said pin means including a cylindrical pin shaft, at least one engaging recess, and a flanged receiving member, wherein said pin shaft has first and second ends such that said first end of said pin shaft has said at least one engaging recess formed transversely of a central longitudinal axis of said pin shaft and formed in an outer circumferential surface of said pin shaft and said second end of said pin shaft has said flanged receiving member; and means for detachably engaging said pin means, wherein said detachably engaging means comprises:

a main body having a through-hole formed through a central longitudinal axis of said main body and a hollow portion formed in said main body through a cylindrical sidewall of said main body so that said through-hole and said hollow portion perpendicularly intersect, wherein said hollow portion includes a main portion and a fitting portion, said fitting portion having a width which is narrower than a width of said main portion, and wherein said through-hole has a diameter only slightly larger than a diameter of said pin shaft so that said pin shaft is slidingly insertable through said through-hole;

an engaging spring having a bent portion at a first end thereof and two spring legs extending from said bent portion to a second end thereof, wherein said engaging spring is slidingly insertable into said hollow portion through an opening in said cylindrical sidewall of said main body so that said bent portion fits in said fitted portion of said hollow portion of said main body and said two spring legs oppose said through hole on at least two sides of said through-hole to engage with said at least one engaging recess of said pin shaft when said pin shaft is inserted in said through-hole.

12. The pierced ear-ring as defined in claim 11, wherein said bent portion corresponds in shape to said fitting portion.

13. The pierced ear-ring as defined in claim 12, wherein said spring legs of said engaging spring have extending portions at said second end thereof such that said extending portions contact sidewalls of said main portion of said hollow portion.

14. The pierced ear-rings as defined in claim 13, wherein said main body has a flat front surface and a stepped back surface.

15. The pierced ear-rings as defined in claim 14, wherein an outer periphery of said front flat surface is integral with a rounded intermediate portion of said main body.

16. The pierced ear-rings as defined in claim 15, wherein said rounded intermediate portion of said main body is integral with said cylindrical sidewall of said main body.

17. The pierced ear-rings as defined in claim 16, wherein said stepped back surface is integral with said cylindrical sidewall of said main body.

18. The pierced ear-rings as defined in claim 17, wherein said stepped back surface of said main body includes a first flat surface and a second flat surface such that said first flat surface is closer to said front flat surface than said second flat surface.

19. The pierced ear-rings as defined in claim 18, wherein said first flat surface of said stepped back surface of said main body has a hole therethrough to said main portion of said hollow portion.

20. The pierced ear-rings as defined in claim 19, wherein said hole through said first flat surface of said stepped back surface of said main body has a longitudinal axis parallel to a longitudinal axis of said through-hole which coincides with said central longitudinal axis of said main body.

21. The pierced ear-rings as defined in claim 20, wherein said pin means and said detachably engaging means are made of a synthetic resin.

22. The pierced ear-rings as defined in claim 20, wherein said synthetic resin is polyboncarbonate.

23. The pierced ear-rings as defined in claim 22, wherein said hole in said first flat surface of said stepped back surface of said main body is for receiving a heated metal bar to melt said resin at a periphery of said hole to bond said bent portion of said engaging spring to said fitting portion of said hollow portion of said main body.

24. The pierced ear-rings as defined in claim 23, wherein said second end of said pin shaft and said flanged receiving member of said second end of said pin shaft have a threaded hole through a central longitudinal axis thereof.

25. The pierced ear-rings as defined in claim 24, wherein said threaded hole in said second end of said pin shaft threadingly accepts a small screw.

26. The pierced ear-rings as defined in claim 25, wherein said small screw aids in mounting an ornamental-portion to said flanged receiving member.

* * * * *